United States Patent [19]

Sugden

[11] 4,352,335

[45] Oct. 5, 1982

[54] YACHT KEELS

[76] Inventor: Keith C. Sugden, 99 Ringley Rd. West, Outwood, Radcliffe, Manchester, M26 9DW, England

[21] Appl. No.: 127,213

[22] PCT Filed: Sep. 14, 1978

[86] PCT No.: PCT/GB78/00014

§ 371 Date: May 16, 1979

§ 102(e) Date: May 16, 1979

[87] PCT Pub. No.: WO79/00151

PCT Pub. Date: Mar. 22, 1979

[30] Foreign Application Priority Data

Sep. 16, 1977 [GB] United Kingdom ..... 38676/77

[51] Int. Cl.[3] ..... B63B 41/00

[52] U.S. Cl. ..... 114/143

[58] Field of Search ..... 114/126–143, 114/39, 280–283, 45

[56] References Cited

U.S. PATENT DOCUMENTS 3,972,300 8/1976 Adamski ..... 114/124

4,044,703 8/1977 Kurtz ..... 114/140

FOREIGN PATENT DOCUMENTS 737888 10/1955 United Kingdom ..... 114/39

*Primary Examiner*—Trygve M. Blix

*Assistant Examiner*—Thomas J. Brahan

*Attorney, Agent, or Firm*—Sughrue, Mion, Zinn, Macpeak and Seas

[57] ABSTRACT

The invention provides a keel comprising two mutually inclined fins 1, 2 which are movable relative to a hull on which the keel is mounted and means such as releasable ratchet devices 31, 32 for locking the fins in any of a plurality of positions relative to the hull. The keel may thus be selectively positioned asymmetrically with respect to the hull to give improved performance and to provide a stable base on inclined surfaces.

13 Claims, 15 Drawing Figures

YACHT KEELS

The present invention relates to keels, and in particular to keels for yachts.

Conventional yacht keels comprise a single downwardly extending fin which is symmetrical with respect to a vertical longitudinal section through the yacht hull when the hull is not heeling. Such keels depend upon their mass and depth to counteract wind forces on the yacht sails which tend to cause the yacht to heel. They are also effective to counteract wind forces tending to push the hull sideways through the water. To provide good performance, single fin keels must be heavy and must extend to a considerable depth, greatly increasing the draught of the yacht.

A major problem with the known single fin keels is that when it is desired to dry out a fixed keel yacht hull, considerable efforts must be made to prop the hull and prevent it toppling over as would otherwise obviously occur once the single fin keel touches bottom. This is a serious problem in shallow tidal bays and often makes the use of expensive purpose built moorings essential.

It is known to provide a yacht hull with two spaced apart fin keels which serve as supports for the hull when it is dried out. Unfortunately such keels are relatively shallow and cannot provide a sailing performance comparable with that obtainable from a single keel of conventional design. In addition, although they can provide support for a dried out hull they cannot accommodate sloping surfaces such as are often found on sandbanks for example.

It is an object of the present invention to provide a keel which obviates or mitigates the above problems by providing a double fin keel the position of which can be altered to obtain good performance and which can also serve as a stable base for a dried out hull.

According to the present invention, there is provided a keel comprising two mutually inclined fins mounted on a hull, characterised in that the fins are movable together relative to the hull, and means are provided for releasably locking the fins in any one of a plurality of positions relative to the hull. Preferably the keel comprises a central hub pivotally supported by the hull, the fins being connected to the hub.

In use, the fins can be moved as desired by releasing the locking means, maneuvering the hull such that it heels to a desired angle with the keel hanging freely, and then locking the keel to the hull. The hull then effectively has an asymmetrical fixed keel which can give improved performance by restraining the heeling of the hull. When a change in direction of travel relative to the wind direction is required, the position of the keel can be reset to provide the asymmetrical keel configuration best suited to the new direction of travel.

As an alternative to relying solely on heeling of the hull to obtain desired hull/keel relative positions, means may be provided to move the keel relative to the hull. These means could be hydraulic for example.

The fins may have any desired configuration, but preferably their ends are shaped to define flat surfaces which are substantially horizontal when the keel is hanging freely. These flat surfaces provide a firm support for the hull even on soft surfaces. Furthermore, the fins may have an airfoil section such that when driven through the water hydrodynamic forces are generated to provide additional resistance to heeling.

The hub preferably comprises two shafts pivotally received in end caps secured to the hull. The locking means may comprise a releasable one way clutch ratchet device provided in each end cap, the ratchet devices being operative when engaged to prevent rotation of the hub relative to the end caps, and release of both ratchet devices allowing the hub to pivot freely on the shafts.

When it is desired to dry out the hull, the locking means are released. As the tide recedes, if at first one of the fins touches the bottom, the fins pivot until the second fin touches the bottom, and then the weight of the hull is progressively taken up by the keel. Means are provided to form the keel and hull together as a result of the weight of the hull acting on the keel, and thus the keel is automatically moved to accommodate inclinations of the underwater surface and then locked to the hull to provide a stable, rigid support.

The ability of the keel to adjust to inclined surfaces makes the keel useful in applications other than sailing yachts. For example, warning markers on shifting sandbacks could be supported on a keel roughly maintained in position by an anchored cable. Each time the tide recedes the keel will adjust to changes in the sandback to maintain the marker in its desired orientation.

A lightweight version could be provided for power boats for example which would provide the drying out facility only.

The keel hub is preferably cast in two sections which are interengaged by a waisted rail on one casting engaging in a socket in the other casting. The fins are also preferably cast and connected to the hub by 'fir tree' joints.

Embodiments of the invention will now be described, by way of example only, with reference to the accompanying drawings, in which.

Figure 5:
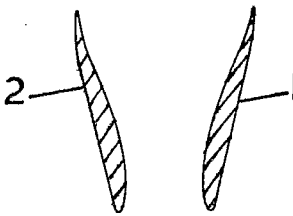
FIG. 5 is a section on line V—V of FIG. 1.

Referring to FIGS. 1 to 5, the general structure of an embodiment of the invention is illustrated in outline. The keel shown comprises two fins 1, 2 mounted on a central hub 3 having an upper surface 4 (FIGS. 1 and 2) which may be fitted to the underside of a boat (not shown). The hub 3 incorporates bearings (not shown) which enable the two fins to pivot together relative to the hub about an axis perpendicular to the plane of FIGS. 1 and 2, and releasable locking means for locking the hub and fins together to prevent such pivoting. Substantially no or very little relative movement can occur between the fins themselves. FIG. 5 shows a section taken on line V—V of FIG. 1. Each fin is an "airfoil" section, in the illustrated case the fin conforming with the dimensional parameters of the family of airfoils known by the reference NACA 8-H-12.

Details of a keel having the general structure shown in FIGS. 1 to 5 will now be described with reference to FIGS. 6 to 13.

Figure 3:
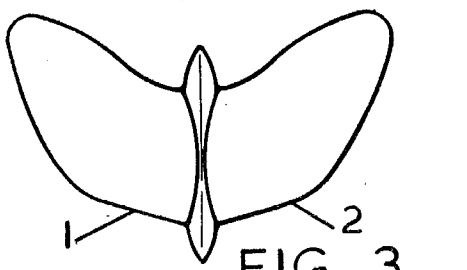
FIGS. 1 to 4 are views taken respectively from in front, behind, beneath and above a keel embodying the invention, each figure showing the keel in outline only.
Figure 4:
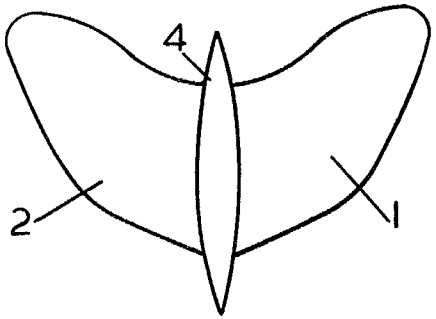
Figure 1:
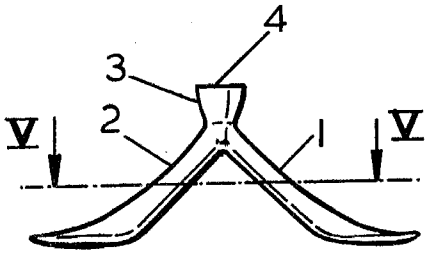
Figure 2:
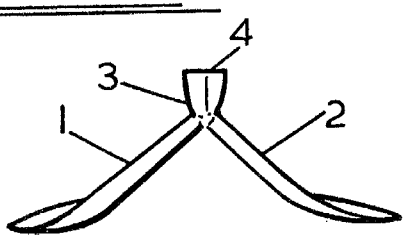
Figure 6:
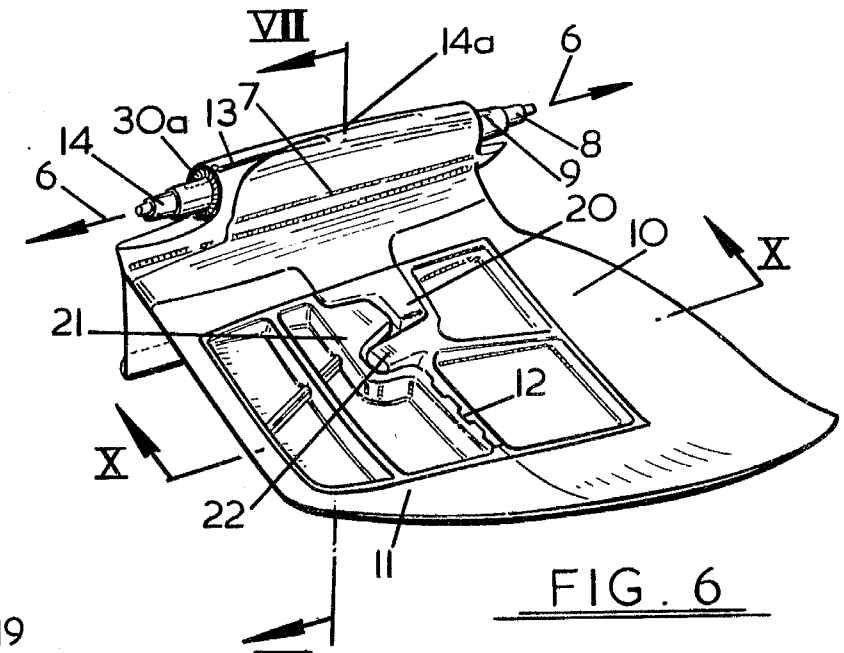
FIG. 6 is a partially cut away perspective view of a keel according to the invention.

FIG. 6 is a perspective view from in front and to one side of the fin assembly which is pivotal about axis 6 in end mountings which will be described below. The fin assembly comprises a first main casting 7 supporting an integral rear pivot shaft 8 having a key 9. Two fin members 10, 11 are mounted on the main casting 7 and mate with each other along castellated edge 12. A second main casting 13 supports an integral front pivot shaft 14. Two fin members, only one of which may be seen in FIG. 6, are mounted on the casting 13 in the same manner as members 10, 11 are mounted on casting 7. The casting 7 and 13 mate with each other along line 14*a*.

Figure 7:
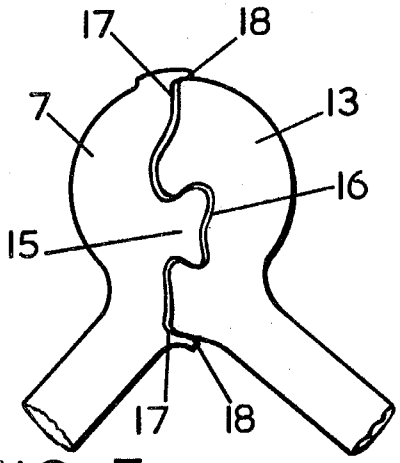
FIG. 7 is a section of a portion of the keel of FIG. 6 taken on line VII—VII of FIG. 6.

FIG. 7 is a part section on the line VII—VII of FIG. 6 and shows a rail 15 provided on casting 7 engaged in a socket 16 provided in casting 13. An elastomeric sheet 17 of for example "Thordon" supplied by Thomson-Gordon Limited, Canada is located between the castings 7 and 13 on either side of the rail 15. The edges 18 of the casting are extended over the edge surfaces of the casting 13 so that such relative movement as occurs between the castings 7, 13 tends to scrape off any marine growth which might build up and so that any tendency for the elastomeric material 17 to be forced out is resisted. The rail 15 and socket 16 are tapered such that the castings can be slid easily into mutual engagement.

Figure 8:
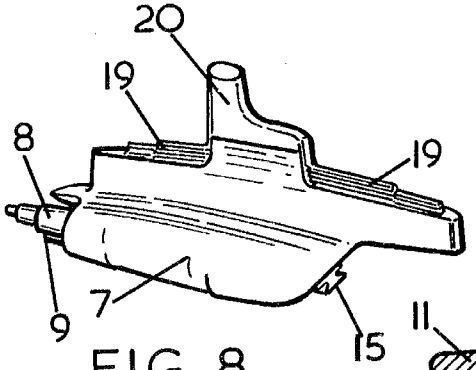
FIG. 8 is a perspective view of a casting used in the keel of FIG. 6.
Figure 10:
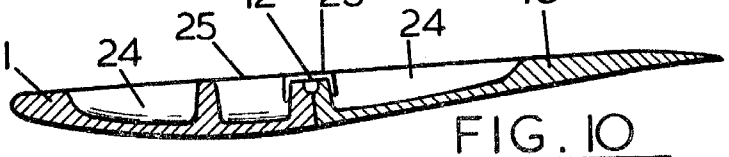
FIGS. 9 and 10 are sections of details of the keel of FIG. 6, FIG. 10 being taken on line X—X of FIG. 6.
Figure 9:
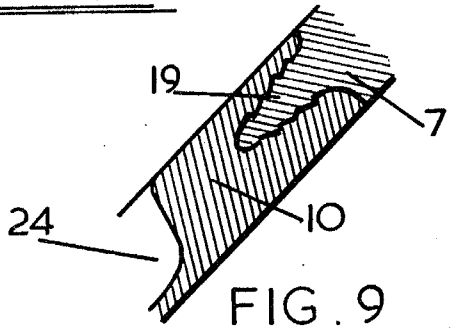

FIG. 8 shows the casting 7 in the inverted position in which it is cast. The casting 7 supports tapered 'fir tree' section ribs 19. Such metal as is left in the pouring gate after casting forms a stub 20 the position of which in the assembly is shown in FIG. 6. The fin members 10, 11 are cast such that stubs 21, 22 which remain after casting are located as shown in FIG. 6, and such that 'fir tree' section sockets are formed in their edges. As shown in FIG. 9, the 'fir tree' section ribs 19 of the main casting can be engaged in the sockets of the members 10, 11 by sliding the latter towards each other until they contact along edge 12 (FIG. 6). As shown in FIG. 10, a channel section member 23 can then be secured over the edge 12 to prevent separation of the members 10, 11. This effectively locks the assembly together.

All the interengaged elements of the constituent parts of the keel are preferably bonded together to give improved strength and rigidity.

Depressions 24 cast in the members 10, 11 allow the introduction of ballast material, e.g. concrete, the assembly being completed by a thin sheet 25 (FIG. 10) which covers the depressions and the casting stubs 20, 21 and 22. Thus a neat, smooth finish is obtained without it being necessary to machine finish the casting stubs.

Figure 11:
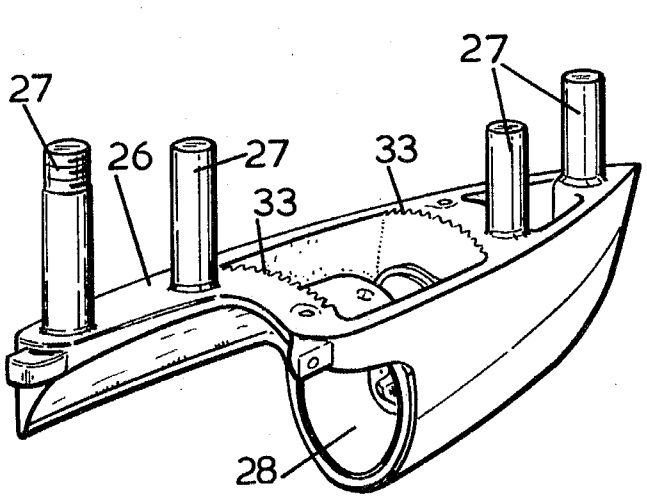
FIGS. 11 to 13 show respectively a perspective view of an end cap casing, an exploded view of components of a ratchet device mounted in the casing, and an end view of the assembled end cap.
Figure 12:
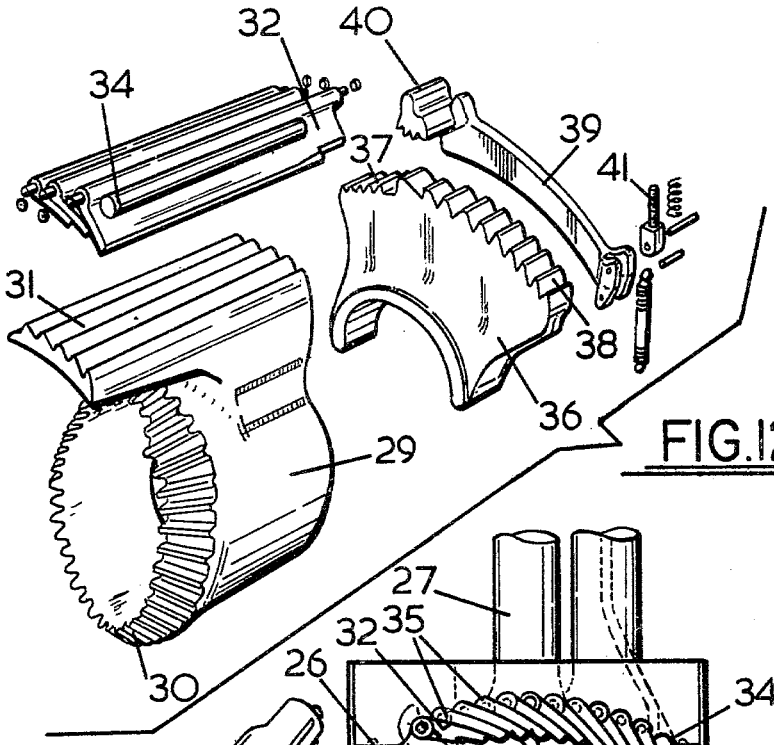
Figure 13:
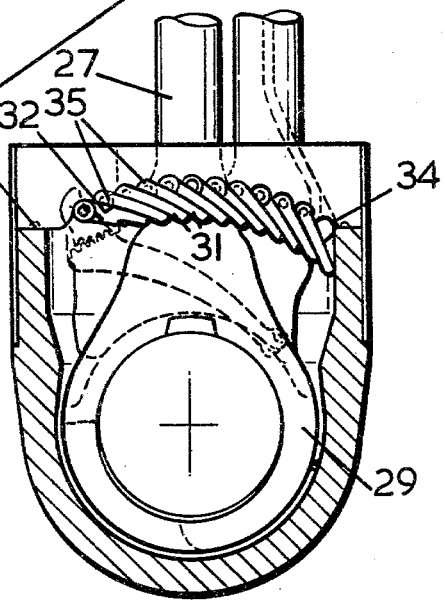

Referring to FIGS. 11 to 13, the mounting assembly for the fin assembly of FIGS. 6 to 10 will be described. The mounting assembly comprises two end caps one of which is shown in FIG. 11 and a base plate on opposite ends of which the end caps are mounted. The base plate is a good fit on the hull of the boat and provides a smooth low drag surface between the hull and the fin assembly between the end caps. The base plate is shown in section in FIG. 13.

Each end cap comprises a flat upper surface 26 which is firmly secured to the base plate by bolts 27 which extend through the base plate and are secured in the hull by means not shown. The end cap defines a hollow cylindrical housing 28 lined with a suitable bearing material in which a sleeve 29 (FIGS. 12 and 13) is received. The bearing material allows relative angular and vertical movement between the shafts and the end cap. The sleeve has a toothed end face 30 which mates with a correspondingly toothed surface 30*a* provided around shafts 8, 14 on the end of the castings 7 or 13 (FIG. 6).

A pivot shaft 8 or 14 is inserted into the sleeve 29 and engages the teeth 30 so that the sleeve is effectively locked to the fin assembly. A toothed surface 31 integral with the sleeve 29 engages a series of ratchet pawls 32 loosely supported in slots 33 (FIG. 11). A resilient rod 34 presses the teeth 32 against the surface 31, the pawls 32 being prevented from coming out of the slots 33 by the under surface 35 (FIG. 13) of the base.

A ratchet release member comprising a plate 36 having two sets of teeth 37, 38 is mounted in the end cap to pivot about an axis parallel to the axis of the pivot shafts 8 or 14, the position of the plate 36 being controlled by a lever 39 acting on a member 40 meshed with teeth 37 (FIGS. 12 and 13). The lever may be pulled up by means of a cable 41 to cause the plate 36 to pivot clockwise (FIG. 13). This causes teeth 38 to push each of the ratchet pawls 32, thereby releasing the fin assembly.

Each end cap incorporates a ratchet device as shown in FIGS. 11 to 13, one ratchet device being arranged to lock the fin assembly against rotation in one direction, the other ratchet device being arranged to lock the fin assembly against rotation in the other direction. Thus the fin assembly can be locked in any desired position.

In use, the two ratchet devices are initially released so that the fin assembly hangs freely beneath the boat. When it is desired to adjust the angular position of the fin assembly relative to the boat, the boat is heeled to the desired angle by appropriate control of the heading of the boat relative to wind direction and by appropriate selection and control of sails. The fin assembly hangs freely beneath the boat and therefore pivots relative to the heeled boat. When the desired angular relationship between the fin assembly and hull are achieved, the ratchet devices are released and lock the fin assembly in the desired position. The boat can then be sailed in a manner which takes advantage of the asymmetrical configuration of the fin assembly as mentioned above.

When it is desired to dry out the boat, for example in a tidal estuary, the boat is moored and the two ratchet devices are released. As the tide goes out, at first one of the fins touches the bottom. The fin assembly then rotates as the tide continues to go out until the other fin touches the bottom. The weight of the boat is then taken by the fins with the result that the shafts 8, 14 are pressed up against the end caps. Sufficient clearance is provided in the end caps for some relative movement to occur between the fin assembly and the end caps so that the ratchet pawls 32, although in the released position, engage the teeth 31. The boat and fin assembly are thus locked together with the fin assembly adjusted to the inclination of the bottom and therefore providing a stable support for the boat. Although the end cap of FIG. 11 supports bolts 27, it might be preferable to provide threaded bore on the end cap after casting thereof. This would make it possible for the fixing points of the fin assembly to be varied to suit a variety of hull designs.

The ratchet pawls 32 of FIGS. 11 to 13 are shown as being received in respective pairs of slots cast into the end cap. As these slots do not have to bear substantial loads a single pair of slotted support members of for example a plastics material could be inserted in appropriate depressions in the end caps.

The angle of the fin assembly pivot axis relative to the horizontal depends primarily on the configuration of the hull to which it is fitted. Variations of a few degrees can however be made by appropriate tapering of the base which is located between the assembly and the hull.

Figure 15:
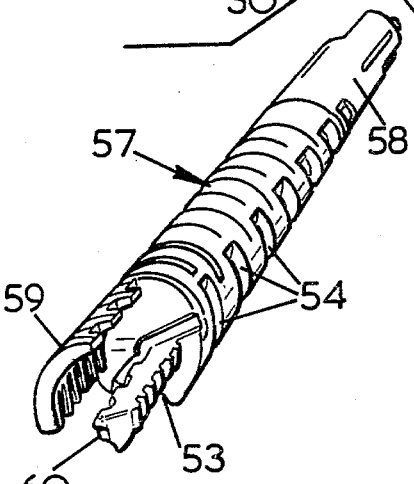
FIGS. 14 and 15 show details of an alternative embodiment of the invention.
Figure 14:
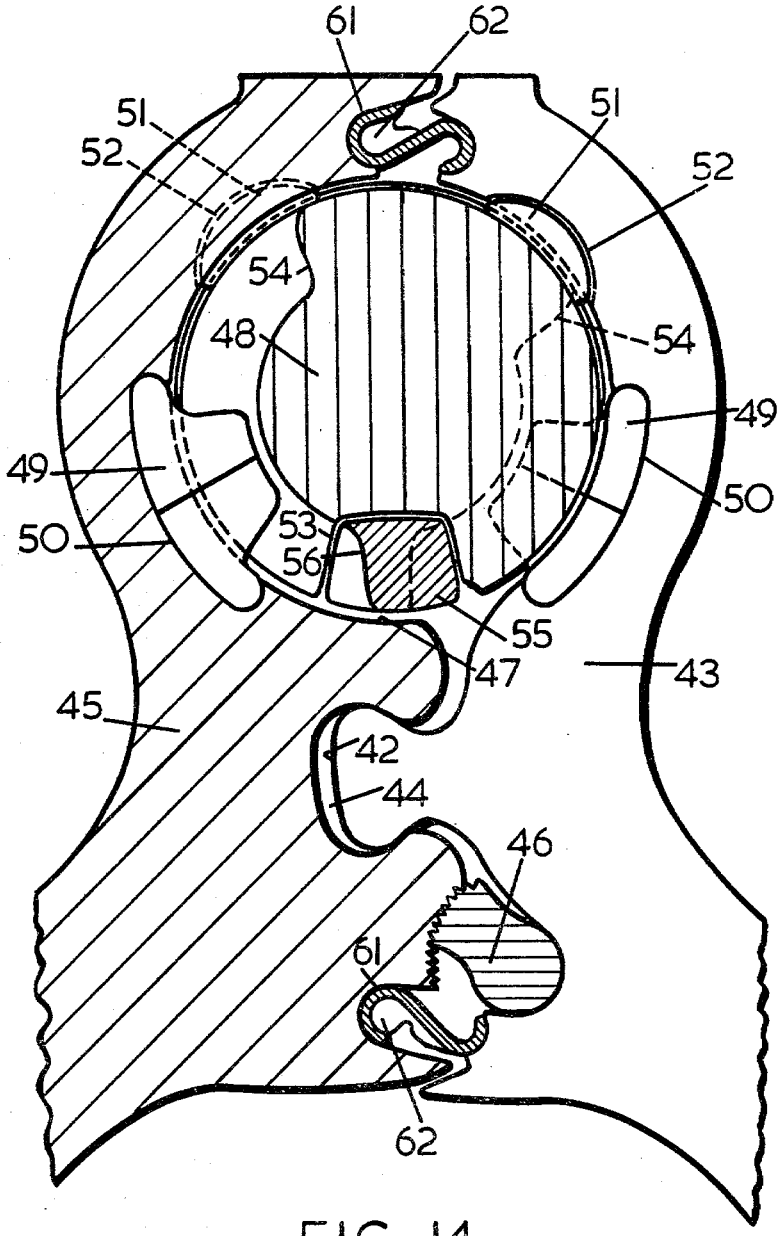

If it is desired to increase the strength of a fin assembly to accommodate the weight of larger boats, the integrally cast shafts 8, 14 of FIG. 6 may be replaced by separate shafts forming a keel bar as shown in FIGS. 14 and 15.

Referring to FIG. 14, which is a section taken partway along the hub, the illustrated embodiment comprises a waisted rail 42 supported on a first main casting 43 and received in a socket 44 provided in a second main casting 45. In addition, a toothed dropping cam 46 is arranged to take up any excess slack between the castings 43, 45 resulting from wear to the rail 42 or socket 44 and particularly wear to an arrangement of locking pegs and slots described below.

The castings 43, 45 together define a generally cylindrical housing 47 in which a keel bar 48 is received. Locking pegs 49 are positioned inside the housing 47, the pegs 49 being offset relative to each other in the longitudinal direction of the bar 48. The pegs 49 are split to enable their insertion into suitable recesses 50 in the housing 47. Elastomeric loadbearing pads 51 are located in recesses 52, each loadbearing pad being positioned opposite to one of the pegs 49.

The keel bar 48 is provided with a longitudinal slot 53 and a series of circumferential slots 54. The slot 53 receives a bar 55 which is itself provided with a series of notches 56 aligned with the slots 54. Each of the slots 54 receives a respective peg 49.

Referring to FIG. 15, the keel bar 48 comprises two identical members each having a central portion 57 in which the slots 54 are provided, an outer end portion 58 which is received in an end cap (not shown) secured to the hull of the boat, and an inner end portion comprising two toothed arms 59, 60. The two keel bar members can be locked together by overlapping the arms 59, 60 and then rotating one member relative to the other such that the arm 59 of one member meshes with the arms 59 and 60 of the other member, and vice versa. Once locked together, the bar 55 (FIG. 14) may be inserted.

Assembly of the hub is achieved by inserting the pegs 49 and pads 51 with the castings 43, 45 separated (longitudinal slots in the pads 51 are used to receive a retaining wire (not shown) to maintain the pads in place during assembly). The keel bar members are then placed in position on their respective castings with their slots 53 offset to correspond with the angular positions of the pegs 49 on the other casting. The castings are then slid together with the tapered rail 42 entering the socket 44. When the castings are fully pushed together, the keel bar members are rotated to engage each other and the member 55 is inserted.

A seal 61 is also inserted during assembly, the seal extending around the entire circumference of the hub to prevent penetration of the hub by water. The seal 61 may include an inflatable enclosure 62 which may be inflated to press the seal against the casing surfaces to enable a suitable bond to be formed between the seal and both castings.

Other details of the assembly, such as the connection of fins to the castings 43, 45 and the end mounting caps which receive the ends 58 of the keel bar are essentially the same as for the embodiment of FIGS. 6 to 13.

In operation, the control of the angular position of the fin assembly is controlled by heeling the boat with the fin assembly free and then locking the fin assembly in position as in the case of the embodiment of FIGS. 6 to 13. The circumferential extent of the slots 54 and notches 56 accommodate the relative movement of the pegs 49 and bar 48. When the boat is dried out however, the fin assembly is locked together as a result of the interaction of the pegs 49 and the keel bar.

When the fin assembly takes the weight of the boat, the pegs 49 are pushed into the slots 54. The pegs and slots are tapered so that they jam in engagement, preventing any further angular movement between the hull and the fins. When the boat is refloated, the weight of the fins and a small relative movement between the fins permitted by rail and socket joint 42, 44, is sufficient to disengage the pegs 49 from the slots 54. Additional means could however be provided to rotate bar 55 to increase the force urging the pegs 49 out of the slots 54.

I claim:

1. A keel, comprising: two mutually inclined fins forming a unitary structure which is mounted on a support secured to a hull such that the fin structure is pivotal about an axis extending longitudinally of the hull and through the support, and means for establishing the angular position of the fin structure relative to the support, said means for establishing the angular position of the fin structure relative to the support comprising locking means which are releasable such that the fin structure can pivot freely relative to the support and are engageable to lock the support and fin structure in any of a plurality of relative angular positions to which the fin structure has pivoted relative to the support, said support comprising a central hub pivotally supported by the hull, the fins being connected to the hub.

2. A keel according to claim 1, wherein the hub comprises two shafts pivotally received in end caps secured to the hull.

3. A keel according to claim 2, wherein the locking means comprises a releasable ratchet device provided in each end cap, the ratchet devices being operative when engaged to prevent rotation of the hub relative to the end caps, and release of both ratchet devices allowing the hub to pivot freely on the shafts.

4. A keel according to claim 2 or 3, wherein each end shaft is free to move perpendicular to its axis relative to the end caps such that an upwards force on the fins is effective to move the end shafts within the end caps and thereby to jam the hub relative to the end caps.

5. A keel according to claim 2, 3 or 4, wherein the shafts are integral with the hub.

6. A keel according to claim 1, wherein the hub defines a housing in which a keel bar is received, the ends of the keel bar defining shafts, and the hub is free to pivot relative to the keel bar when said locking means are released.

7. A keel according to claim 6, wherein the keel bar is free to move perpendicular to its axis relative to the housing such that an upward force on the fins is effective to jam the hub housing and keel bar together.

8. A keel according to claim 7, wherein the keel bar comprises circumferential tapered grooves in which tapered pegs supported inside the hub housing are engageable to jam the hub and keel bar together when the hub is forced upwards relative to the keel bar.

9. A keel according to claim 1, wherein the hub comprises two interengaged castings.

10. A keel according to claim 9, wherein one casting supports a waisted rail engaged in a socket provided in the other casting.

11. A keel according to claim 9 or 10, wherein the fins are connected to respective hub castings by cast 'fir tree' joints.

12. A keel according to claim 1 or 6, wherein the ends of the fins are shaped to define flat substantially horizontal lower surfaces adapted to provide a firm support on a soft surface.

13. A keel according to claim 1 or 6, characterised in that each of the fins is in the form of an airfoil section.

* * * * *